US005413513A

United States Patent [19]

Horne et al.

[11] Patent Number: 5,413,513

[45] Date of Patent: May 9, 1995

[54] METHOD OF MAKING FLAT ELECTRON DISPLAY DEVICE WITH SPACER

[75] Inventors: Remko Horne; Maarten A. Van Andel; Gerardus N. A. Van Veen, all of Eindhoven, Netherlands

[73] Assignee: U.S. Philips Corporation, New York, N.Y.

[21] Appl. No.: 221,147

[22] Filed: Mar. 30, 1994

Related U.S. Application Data

[60] Division of Ser. No. 195,975, Feb. 10, 1994, Pat. No. 5,371,433, which is a continuation of Ser. No. 825,673, Jan. 27, 1992, abandoned.

[30] Foreign Application Priority Data

Jan. 25, 1991 [NL] Netherlands ..... 9100122

[51] Int. Cl.[6] ..... H01J 9/02

[52] U.S. Cl. ..... 445/24; 430/325

[58] Field of Search ..... 445/24, 25; 430/325

[56] References Cited

U.S. PATENT DOCUMENTS

| | | | |
|---|---|---|---|
| 4,923,421 | 5/1990 | Brodie | 445/24 |
| 5,083,958 | 1/1992 | Longo et al. | 445/24 |
| 5,209,688 | 5/1993 | Nishigaki et al. | 445/24 |

*Primary Examiner*—Kenneth J. Ramsey
*Attorney, Agent, or Firm*—Norman N. Spain

[57] ABSTRACT

In a flat display device, for example, a luminescent display a spacer structure (5) is provided between two substrates (1, 3). To this end a mask (9, 15) consisting, if necessary, of a plurality of layers is incorporated in a photosensitive material (8, 13). After exposure, development and removal of the mask, the desired spacer structure is obtained.

10 Claims, 2 Drawing Sheets

METHOD OF MAKING FLAT ELECTRON DISPLAY DEVICE WITH SPACER

RELATED APPLICATIONS

This application is a division of application Ser. No. 08/195,975, filed Feb. 10, 1994, now U.S. Pat. No. 5,371,433, which application is a continuation of application Ser. No. 07/825,673, filed Jan. 27, 1992 and now abandoned.

BACKGROUND OF THE INVENTION

The invention relates to a flat display device comprising a first substrate, at least one electron source and a second substrate spaced apart from the first substrate by at least one spacer made of an organic polymer.

The invention also relates to a method of manufacturing such a display device.

Flat display devices of this type are used as display panels in, for example, portable computers, and in other applications where the use of cathode ray tubes may give rise to problems. Moreover, there is increasing interest in using flat display devices in video applications.

Flat display device of the type mentioned above is described in PCT/WO-90/00808. In the device, spacers made of polyimide are manufactured by coating a substrate with a layer comprising a polyamide ester, subsequently drying this layer and patterning it photolithographically. Exposure to ultraviolet radiation, followed by development further treatment, polyimide spacers having a height of 100 to 150 μm are obtained.

However, the above described display device has a number of drawbacks. For example, the inside of the display panel provided with phosphors and with a conducting layer of, for example, aluminum or indium-tin oxide for the purpose of transporting electrons. To obtain a satisfactory display, for example in television applications, an accelerating voltage of the order of 2 to 5 kV is required (dependent on the materials used, gas filling, etc.) between the first substrate (where electron sources in the form of field emitters are present in said device) and the second substrate. In the device according to PCT/WO-90/00808 the spacers consist of an organic chemical material (polyimide). At said high such high accelerating voltages this may lead to graphite formation via flash-over in the vicinity of the organic chemical spacer material (polyimide), so that both the vacuum and the electrical behaviour of the device may be influenced detrimentally. Though it is possible to prevent this by providing the spacers with a suitable coating (for example, chromium oxide or silicon oxide), this requires additional process steps, such as vapour deposition while simultaneously rotating the substrate, or preferential precipitation from a liquid, while projecting the substrate from the treatment.

Another drawback of the device shown in PCT/WO-90/00808 is that an adjacent pixel may be excited by backscattered or secondary electrons.

OBJECTS AND SUMMARY OF THE INVENTION

One of the objects of the present invention is to provide a flat electron display device of the type described hereinbefore in which high accelerating voltages can be used without said graphite formation or other problems occuring due to a too high field strength.

It is another object of the invention to provide such a display device in which problems due to backscattering or secondary emission do not occur.

It is a further object of the invention to provide a method of manufacturing such a display device having two substantially parallel substrates.

A display device according to the invention is therefore characterized in that the distance between the two substrates is at least 200 μm, whereby the field strength may be smaller than in thinner devices using the same accelerating voltage, and thus the risks of forming graphite and influencing the vacuum are reduced considerably.

The invention is based on the recognition that this can be achieved, inter alia, by a cumulative effect of steps as described herein without each time repeating each step completely. It is further based on the recognition that, viewed in a cross-section, this repetitive treatment produces spacers at different levels with different cross-sections.

It appears that spacers up to a height of approximately 1 mm can be realised in this way, with a surface of the cross-section at the area of the first substrate (where this surface is usually smallest due to the method used) of between 100 and 10,000 $\mu m^2$, and a pitch between the pixels is generally of the order of 50 to 500 μm.

A preferred embodiment of a display device according to the invention is characterized in that cross-sections of the spacers, viewed at different heights of the spacers, have different patterns.

It can thereby be achieved, for example, that viewed in a cross-section the spacer (which consists of, for example polyimide) forms a closed structure around a pixel at least at the area of the second substrate. This may be a rectangular structure, but it is preferably honeycomb-shaped. The closed structure at the location of the pixels prevents scattering of electrons to adjacent pixels.

If the display mechanism is based on the excitation of phosphors by means of electrons as described in PCT/WO-90/00808, the first substrate comprises, for example, a matrix of electron sources such as field emitters; alternatively, each electron source may be built up of a plurality of field emitters or, if the first substrate is a semiconductor, it may be integrated in this semiconductor body.

Another preferred embodiment of a display device according to the invention is characterized in that a spacer is intersected by at least one layer of conducting material.

In this way acceleration grids can be integrated into the spacers, for example, by providing structured metal layers.

A method according to the invention is characterized in that a layer of patternable organic material having a thickness of at least 200 μm is provided on a substrate in which at least one spacer is defined photolithographically.

The layer is preferably provided by means of sub-layers in which, if necessary, auxiliary masks are provided photolithographically between two sub-layers, while in a plan view the auxiliary masks and the mask on the last-provided layer do not overlap each other or overlap each other only partially.

Alternatively, after at least one sub-layer has been provided, a part of the spacer can be defined in portions of the patternable material, whereafter this material is provided with a patterned layer of conducting material which in its turn is covered with at least one sub-layer for defining further portions of the spacer. In this way, said integrated acceleration grids can be obtained.

These and other aspects of the invention will now be described in greater detail with reference to the drawing and the accompanying description of some embodiments and the drawing.

DESCRIPTION OF THE PREFERRED EMBODIMENTS

Figure 1:
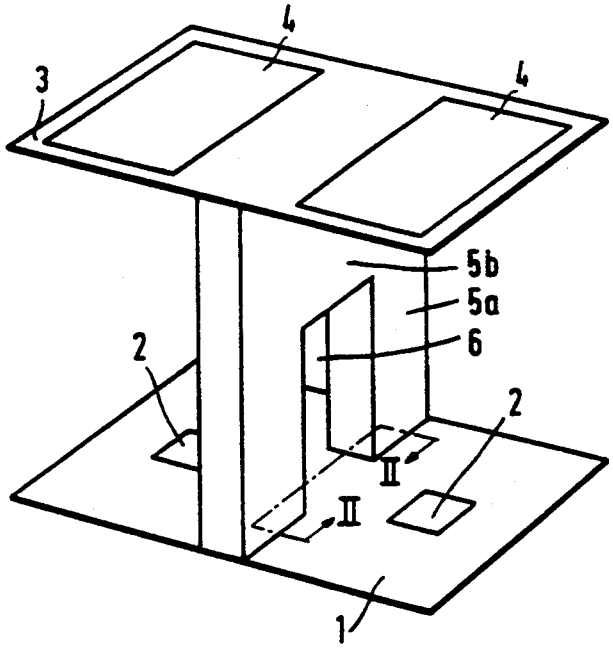
FIG. 1 is a diagrammatic representation in perspective, of a portion of a display device according to the invention.
Figure 2:
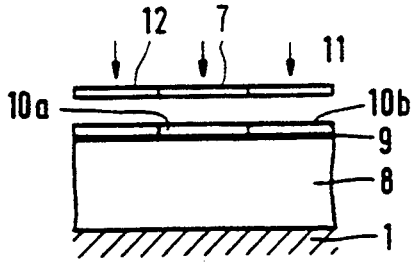
FIGS. 2 through 7 show diagrammatically a section view of the display device of FIG. 1, taken on the line II—II in FIG. 1, during several stages of manufacture.

FIG. 1 shows a portion of a display device according to the invention, comprising a first substrate, of, for example, glass or silicon which is provided with a matrix of electron sources 2 (for example, field emitters) which are manufactured in a known manner. The pixels 4, which in this example substantially coincide with phosphors provided on the side of substrate 3 opposite the electron sources 2, are present opposite the electron sources on a second substrate 3 of glass. Although only two pixels 4 are shown, the device actually comprises at least 100,000 to 1,000,000 pixels, dependent on the type of device (monochrome, colour high definition).

The substrates 1 and 2 are spaced apart by approximately 500 μm by means of spacers 5. These spacers comprise two parts, namely a first part 5*a* at the area of the first substrate 1 and a second pan 5*b* at the area of the pixels 4 on the second substrate 3. The parts 5*b* may extend entirely around a pixel 4. The device shown is driven by causing electrons from the sources 2 to impinge upon the phosphors associated with the pixels 4. Backscattered electrons now impinge upon the parts 5*b* and thus cannot influence the adjacent pixels. Due to the large distance between the two substrates, a comparatively high voltage difference can be applied therebetween (5–10 kV) without any danger of flash-over. The display device can be evacuated via the apertures 6 in the spacers 5.

The device of FIG. 1 may be manufactured as follows (see FIGS. 2 to 7).

The manufacture starts from a first substrate 1, for example, a semiconductor substrate (silicon or glass in this example) in which or on which electron sources (not shown) are formed, for example field emitters, but semiconductor cathodes as described in U.S. Pat. No. 4,303,930 in the name of the Applicant are also possible. A layer 8 of photosensitive polyamide acid or polyamide ester having a thickness of approximately 300 μm is then provided on the substrate 1. A suitable polyamide ester is, for example Probimide 348 FC of the firm of Ciba-Geigy. Thin layers (up to approximately 100 μm) can be applied by means of a single spin-coating treatment of the polyamide ester. Such a layer thickness can be provided in accordance with the method described herein with reference to FIGS. 8 and 9, or with a suitable tool such as a "spacer knife". To protect the electron sources, a protective coating can be temporarily provided, if necessary.

Figure 3:
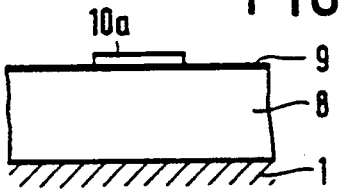
Figure 4:
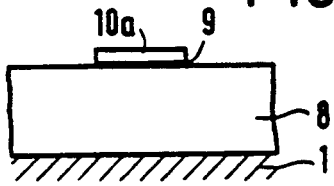
Figure 5:
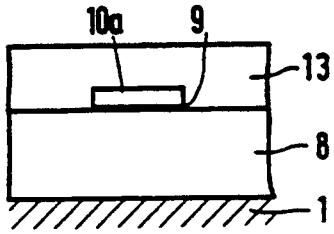
Figure 6:
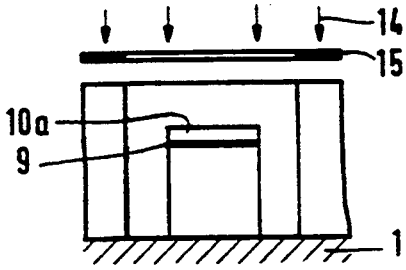
Figure 7:
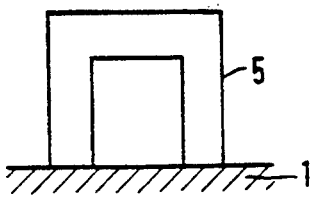

The layer 8 is subsequently covered with a thin layer 9 (approximately 40 nm) of gold after which a layer of positive photoresist 10 is provided. After exposure to ultraviolet radiation (shown diagrammatically by means of arrows 11) through a mask 12 which defines apertures 7, and after development, the parts 10*b* are removed and the pan 10*a* of the photoresist is left (FIG. 3). Using the remaining photoresist as a mask, the gold layer 9 is subsequently etched wet-chemically in an etchant suitable for this purpose (for example, an aqueous solution of 25% KI arid 10% $I_2$). The structure thus produced FIG. 4 is coated again with a photosensitive layer 13 of polyamide ester having a thickness of approximately 100 μm (FIG. 5). The assembly is subsequently exposed to ultraviolet and visible radiation (shown diagrammatically by means of arrows 14 in FIG. 6) via a mask 15, which defines the parts 5*b* of the spacers. The wavelength used and the duration of the exposure depend on the light intensity, the material used and the thickness of the layers 8, 13 (for a layer of Probimide 348, with a thickness of approximately 200 μm and exposure to the entire Hg spectrum the light intensity is, for example 15 mW/cm$^2$ for 200 seconds). Since, the opening in mask 15 is greater than the area of the auxiliary mask formed by the layers 9 and 10*a* the polyamide ester is exposed and cured throughout the thickness of the layers 8, 13 between the edges of the auxiliary mask and mask 15, and these cured parts 5 are left on the substrate 1 in a subsequent development step. After cleaning, removal of the layers 9, 10*a*, possible further cleaning steps and a thermal post-treatment, the structure of FIG. 7 is obtained.

The substrate 1 thus provided with emitting sources and spacers 5, is then laid on a second substrate 3 of, for example glass, provided with phosphors. After aligning the phosphors with respect to the electron sources, the assembly is sealed along the edges and evacuated. The device of FIG. 1 is then obtained.

Figure 8:
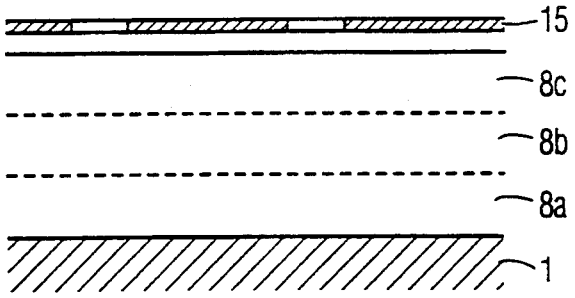
FIGS. 8 and 9 show diagrammatically in perspective partly sectioned, portion of another display device of the invention according to the invention.
Figure 9:
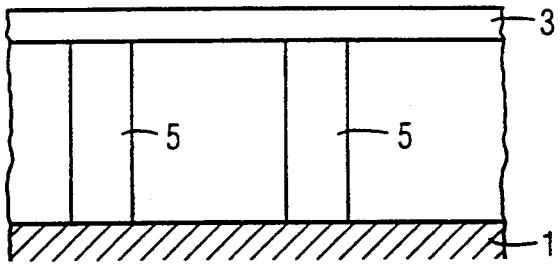

FIGS. 8 and 9 show how spacers having a height of 200 to 1000 μm can be obtained. The polyimide layer 8 is obtained by successively providing sub-layers 8*a*, 8*b*, 8*c*. Each subsequent sub-layer is not provided until the previous sub-layer has acquired a defined layer thickness (for example by means of spin-coating). Subsequently the locations of the spacers to be formed are defined via a mask 15, whereafter the assembly is exposed, developed, cured etc. The spacers 5 thus formed keep the two substrates 1, 3 of FIG. 9 spaced apart by, for example 450 μm. In this example no auxiliary masks are used so that the spacers have a uniform cross-section; in practice the cross-section at the area of the first substrate will usually be slightly smaller because a negative photosensitive system is used and because there is light absorption in the layer.

Although the device shown as device is shown with an electron source for each pixel, the spacers may also be used in other flat display devices such as described in, for example, U.S. Pat. No. 4,853,585 (PHN 12.047).

Figure 10:
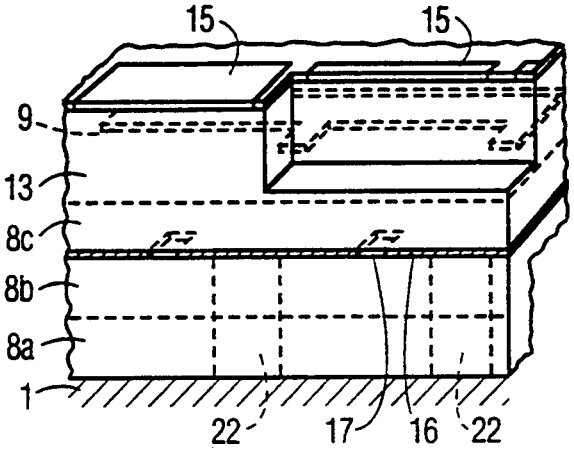
FIGS. 10 and 11 show the manufacture of a further device.
Figure 11:
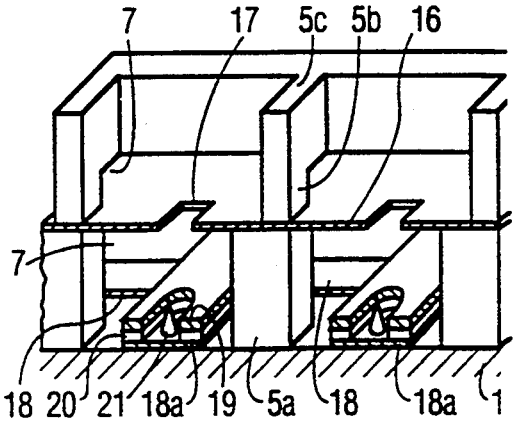

FIG. 10 shows the manufacture of another display device, partly in a cross-section and partly in a plan view. The method starts again from a substrate 1, for example a glass plate on which a matrix of field emitters is provided. Sub-layers 8*a*, 8*b* of polyamide ester are deposited on the substrate 1 in the same way as described hereinbefore. By exposure with ultraviolet radiation, cured areas 22 are formed in the sub-layers at the area of lower portions of the spacers to be formed. The layer thus formed is, however, not yet developed but is first covered with a thin metal layer 16 having apertures 17 above the emitters. The metal layer 16 may be provided in advance with the apertures 17, but the pattern of apertures (or any other desired pattern) may also be provided after information of the metal layer by means of selective etching. Subsequently, a layer 8*c* of polyamide ester is provided, which in turn is covered with a gold layer 9 patterned by means of etching. Subsequently, an additional layer 13 of polyamide ester is provided, whereafter the assembly is exposed with ultraviolet and/or visible radiation via a mask 15. After development, rinsing and optional further treatment, the device of FIG. 11 is obtained. This device has a substrate 1 on which square column-shaped parts 5*a* of the spacers are present. The other parts of the spacers consist of similar column-shaped parts 5*b* and parts 5*c* which are closed along their circumference and which enclose pixels (phosphors) in the ultimate display device. The metal layer 16, which has apertures 17 at the location of field emitters 21, is present between the parts 5*a* and 5*b* of the spacers. The plate 16 may now function as a common accelerating electrode. To suppress possible backscattering to a further extent, the walls of the closed parts 5*c* may be coated with a conducting layer which is through-connected to the front plate 3 in, for example, an electrically conducting manner. This can also be achieved by providing a grid which is comparable with the metal layer 16 and by short-circuiting it electrically with the front plate 3.

FIG. 11 also shows diagrammatically two field emitters 21. In the present example, they form pan of a matrix of field emitters which are driven by X lines 18 and Y lines 19 and are mutually insulated by means of an insulation layer 20 at the area of their crossings where the X lines are provided with connection strips 18*a*. Apertures 7 which enable drawing a vacuum during sealing, are present between the parts 5*a* and between the parts 5*b*.

Figure 12:
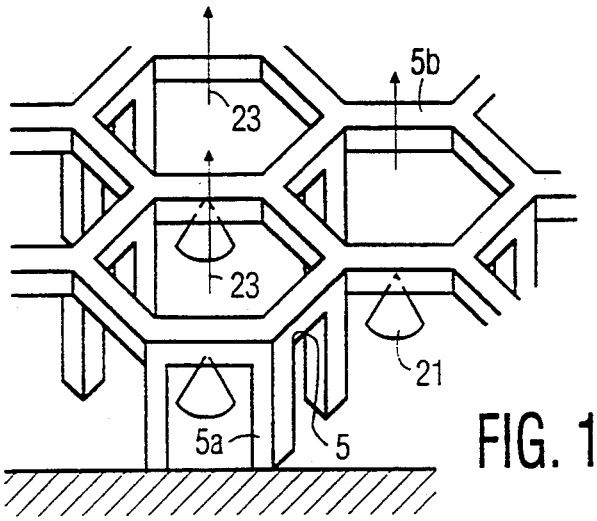
FIG. 12 shows diagrammatically in perspective yet a further display device according to the invention.

Finally, FIG. 12 shows a modification in which the closed parts 5*b* of the spacers have a honeycomb structure. Otherwise, the reference numerals denote the same elements as in the previous Figures. The exiting electron current is shown diagrammatically by means of arrows 23.

The invention is of course not limited to the examples shown, but several variations are possible within the scope of the invention. For example, the structure in which the spacers are defined can also be provided on the glass plate with phosphors instead of on the substrate 1. A plurality of metal masks may also be provided between the sub-layers so that, as it were, a pan of the electron-optical system is integrated in the spacer(s).

We claim:

1. A method of manufacturing spacer elements comprising:

a) providing a layer comprising of at least two sublayers of radiation-curable organic polymer material on a surface of a substrate, b) providing a mask on said layer, c) exposing said sublayers to radiation through said mask to thereby cure unmasked portions of said sublayers and then developing said sublayers to thereby remove uncured portions of said sublayers to thereby form said spacers.

2. A method of manufacturing a display comprising providing a first substrate comprising electron sources and a second substrate comprising phosphors, providing one of said substrates with spacers by means of a method of claim 1, said spacers being provided on a surface of said substrates comprising said electron sources or said phosphors, and joining said substrates in a manner such that said electron sources and said phosphors oppose each other.

3. A method of manufacturing spacer elements comprising:

a) providing a first sublayer of a radiation-curable organic polymer material on a surface of a substrate, b) providing a first mask on said first sublayer, said first mask having at least one opening, c) providing at least one further sublayer of said radiation-curable organic polymer material on the resultant masked first layer, d) providing auxiliary masks, each having at least one opening, between each of said further sublayers, e) providing a final mask, having at least one opening, on a surface of the further sublayer most remote from said substrate, all of said masks being arranged so that, viewed in a direction perpendicular to the surface of said substrate, the openings overlap each other at most only partially, f) exposing the resultant assembly to radiation to thereby cure unmasked areas of said sublayers and then developing said sublayers to thereby remove uncured portions of said sublayers thereby forming said spacer elements.

4. A method of manufacturing a display comprising providing a first substrate comprising electron sources and a second substrate comprising phosphors, providing one of said substrates with spacers by means of a method of claim 3, said spacers being provided on a surface of said substrates comprising said electron sources or said phosphors, and joining said substrates in a manner such that said electron sources and said phosphors oppose each other.

5. A method of manufacturing spacer elements comprising:

a) providing a first organic layer comprised of at least one sublayer of a radiation-curable polymer material on the surface of a substrate, b) providing said first organic layer with a first mask, c) exposing said first layer to radiation through said first mask to thereby cure unmasked portions of said first layer, d) providing a layer of electrically conductive material having at least one opening on said first mask, e) providing a second layer comprised of at least one sublayer of a radiation-curable organic polymer material on said layer of conducting material, f) providing a second mask having at least one opening on said second layer, said first and second masks and said layer of electrically conductive material being arranged so that, viewed in a direction perpendicular to the surface of said substrate, the openings overlap each other at most only partially, g) exposing said second layer to radiation through said mask to thereby cure unmasked portions of said second layer and then developing said layers thereby forming said spacer elements.

6. A method of manufacturing a display comprising providing a first substrate comprising electron sources and a second substrate comprising phosphors, providing one of said substrates with spacers by means of a method of claim 5, said spacers being provided on a surface of said substrates comprising said electron sources or said phosphors, and joining said substrates in a manner such that said electron sources and said phosphors oppose each other.

7. A method of manufacturing spacer elements comprising:

a) providing a first layer comprising at least one sublayer of a radiation-curable organic polymer material on a surface of a substrate;

b) providing a first mask having at least one opening on said first layer, c) exposing said first layer to radiation through said first mask to thereby cure unmasked portions of said first layer, d) providing a layer of electrically conductive material having at least one opening on said first mask, e) providing at least one further sublayer of a radiation-curable organic polymer material on said layer of conductive material, f) providing auxiliary masks, each having at least one opening between each of said further sublayers, g) providing a final mask, having at least one opening, on a surface of the further sublayer most remote from said substrate, all of said masks and said layer of conductive material being arranged so that, viewed in a direction perpendicular to said substrate said openings overlap only partially, h) exposing the at least one further sublayer to radiation through said masks and said layer of conductive material to thereby cure unmasked portion of the at least one further sublayer and then developing the at least one further sublayer and said first layer to thereby form said spacer elements.

8. A method of manufacturing a display comprising providing a first substrate comprising electron sources and a second substrate comprising phosphors, providing one of said substrates with spacers by means of a method of claim 7, said spacers being provided on a surface of said substrates comprising said electron sources or said phosphors, and joining said substrates in a manner such that said electron sources and said phosphors oppose each other.

9. A method of manufacturing spacer elements for a display device comprising an electron-emitting surface, and, at a small distance opposite said electron-emitting surface, a surface comprising phosphor elements, substrates comprising said surfaces being separated one from the other at a small distance by a matrix of said spacer elements contacting said surfaces, said method comprising:

a) providing a layer formed of at least two sublayers, each sublayer of a radiation-curable organic polymer material, on one of said surfaces, b) applying a mask to said layer, c) exposing said sublayers to radiation through said mask to thereby cure unmasked portions of said sublayers and then developing said sublayers to thereby remove uncured portions of said sublayers and thereby form said spacers.

10. The method of claim 1, wherein the layer has a thickness of at least 200 μm.

* * * * *